US005549214A

United States Patent [19]

Harris

[11] Patent Number: 5,549,214

[45] Date of Patent: Aug. 27, 1996

[54] CLOSURE DEVICES

[75] Inventor: John Harris, Newport, United Kingdom

[73] Assignee: Frontier Plastics (South Wales) Limited, Gwent, United Kingdom

[21] Appl. No.: 190,372

[22] Filed: Feb. 2, 1994

[30] Foreign Application Priority Data

Feb. 12, 1993 [GB] United Kingdom ..... 9302790

[51] Int. Cl.[6] ..... B65D 43/16

[52] U.S. Cl. ..... 220/339; 220/908; 220/254

[58] Field of Search ..... 206/366; 220/254, 220/259, 281–283, 324, 333, 339, 908

[56] References Cited

U.S. PATENT DOCUMENTS

| | | | |
|---|---|---|---|
| 1,007,429 | 10/1911 | Canepa | 220/339 |
| 2,195,593 | 4/1940 | Kreisler | 220/259 |
| 3,419,198 | 12/1968 | Petterson | 220/339 |
| 3,845,872 | 11/1974 | Towns | 220/281 |
| 3,964,609 | 6/1976 | Perrella | 220/254 |
| 4,717,018 | 1/1988 | Sacherer et al. | 220/339 |
| 4,736,858 | 4/1988 | Shastal | 220/254 |
| 5,107,990 | 4/1992 | Wicherski | 206/366 |
| 5,201,417 | 4/1993 | Outlaw | 206/366 |
| 5,273,177 | 12/1993 | Campbell | 220/254 |
| 5,346,086 | 9/1994 | Hanis | 220/254 |

*Primary Examiner*—David Scherbel
*Assistant Examiner*—Terrence R. Till
*Attorney, Agent, or Firm*—Young & Thompson

[57] ABSTRACT

A flap 10 has a first portion 11 flexibly connected to a lid 2 and a second portion 13 connected to the first portion 11 by an integral flexible hinge strip 14. The second portion also 13 carries pivot pins 15 which locate into an upstanding rim 16 of the lid portion 2. These pivot pins are slightly offset vertically and horizontally from the flexible hinge 14 thus enabling the flap 10 to be toggled between two stable conditions. In the first of these the hinge 14 is snapped to a position above the pivot pins 15 thus pressing the second flap portion 13 positively down into the opening 6. If pressure is applied to the first portion 11 the flexible hinge 14 will be forced down past and below the pivot pins 15 thus causing the second flap portion 13 to flip upwardly into the alternative stable condition.

10 Claims, 2 Drawing Sheets

CLOSURE DEVICES

This invention is concerned with devices for creating a secure closure to an opening in a container. This container may, for example, be one which is intended to hold sharps (hypodermic needles and the like) and surgical and medical waste. The closing of such a container needs to be very positive and not susceptible to accidental opening. The closure device could also be useful for such containers as are intended to hold substances such as washing powder which needs to be poured out from time to time.

According to the present invention there is provided a container closure device for an opening in a lid portion of a container, and comprising a flap flexibly connected at one end to the lid portion and having first and second portions either side of a snap action hinge which is located on the lid portion, the second flap portion being furthest from said flexible connection and being positioned to close off said opening when the snap action hinge is in one of its two stable conditions.

With such an arrangement the snap action hinge will hold the second flap portion securely in place over the opening in the lid portion until such time as suitable positive pressure is applied to the first flap portion to toggle it into its other stable condition. In the preferred arrangement the snap action hinge comprises a pivot connection to the lid portion and a flexible hinge close to the pivot across said first flap portion in a plane above the pivot axis. Ideally the flexible connection and the flexible hinge are integrally moulded thinner portions of a moulded plastics flap and lid portion combination. The flexible hinge (and indeed the flexible connection) then takes the form of what is commonly termed a "living hinge". Preferably, a recessed part of the lid portion receives the first flap portion in either of its two operating positions. Advantageously the underside of the first flap portion within this recessed part can then incorporate ribs which angle down from the flexible hinge into the recess towards said flexible connection. The lower ends of the ribs then act as pressure points on the recessed part as a second flap portion is pushed down and the sloping lower faces of the ribs seat the second flap portion into the base of the recessed part in the other stable condition of the hinge with the first flap portion raised in the open condition.

It is preferable that there should be a locking device operable to prevent operation of said snap action hinge. This locking device can comprise one or more movable tabs which can be adjusted to lie below the first flap portion near to the flexible hinge. Locking can be made more or less reversible by providing that the or each tab is movable into its locking position into engagement with a holding formation on the lid portion and/or the first flap portion for resisting return movement of the tab.

For many uses it may be desirable to provide that the underside of the second flap portion carries a resilient sealing pad for sealing engagement over the opening in the lid portion. In some instances it is desirable to provide the lid portion with an upstanding rim around the whole of the flap when the flap is in its closed position. Such a rim may, however, be disadvantageous if the container is to incorporate substances which are intended to be poured out.

The invention may be performed in various ways and a preferred embodiment will now be described, by way of example, with reference to the accompanying drawings, in which.

Figure 1:
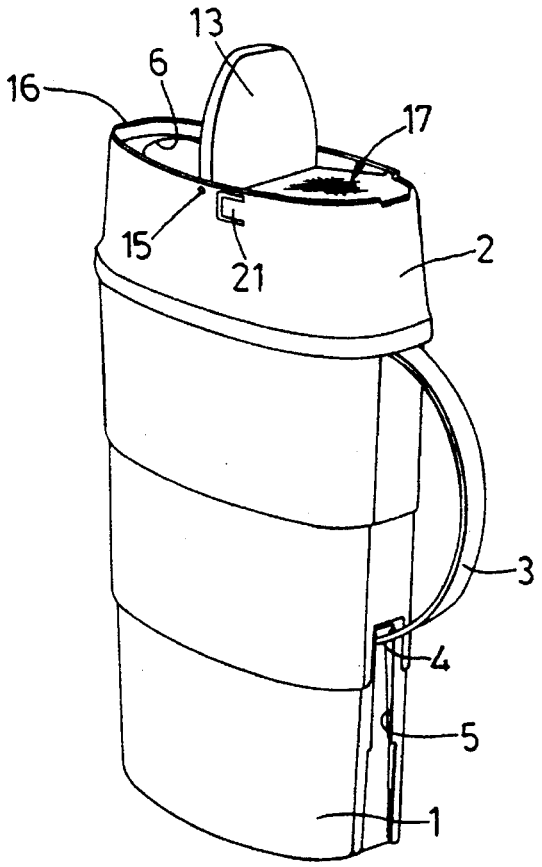
FIG. 1 is a perspective view of a container incorporating a closure device of this invention.
Figure 2:
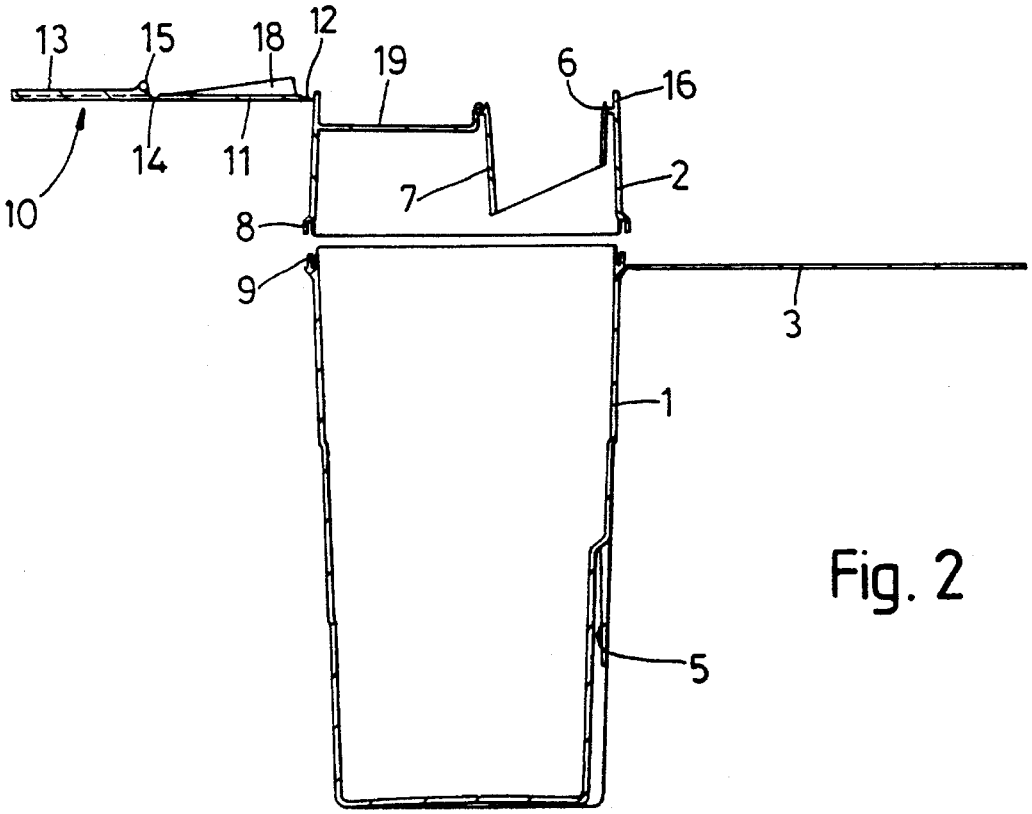
FIG. 2 is a vertical section through the combination of the container with the lid portion incorporating parts of the closure device.
Figure 3:
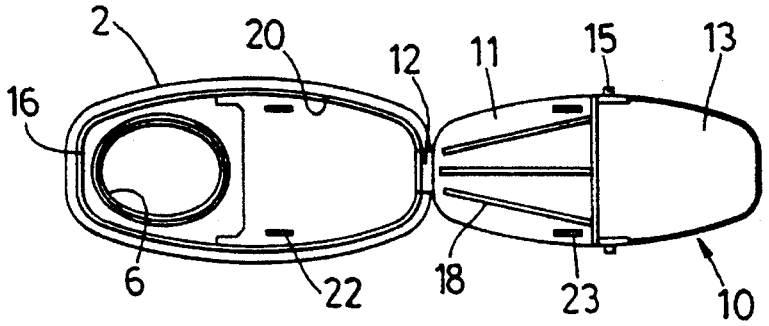
FIG. 3 is a plan view of the parts of the lid and closure device as shown in FIG. 3.

The container illustrated in FIGS. 1 to 3 comprises a base portion 1 onto which is fitted a lid portion 2. A strap handle 3 has a enlarged end 4 which fits into a slot 5 in a side wall of the base 1. This handle can then be slid between a carrying position and a flattened storage position. The lid 2 has an opening 6 formed in the top surface thereof providing access to the interior of the base 1 via a chute 7. The lid and base are fitted together by interlocking engagement portions 8 and 9.

Figure 4:
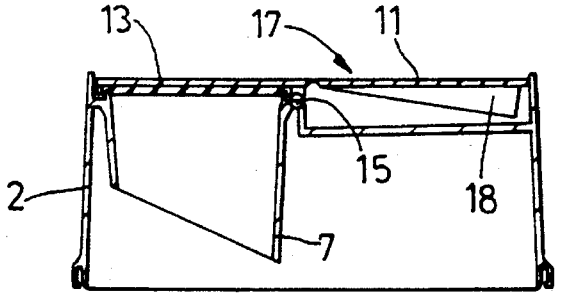
FIGS. 4 and 5 are vertical longitudinal sections through the lid of the container of FIG. 1 showing the closure device respectively in the closed and open conditions.
Figure 5:
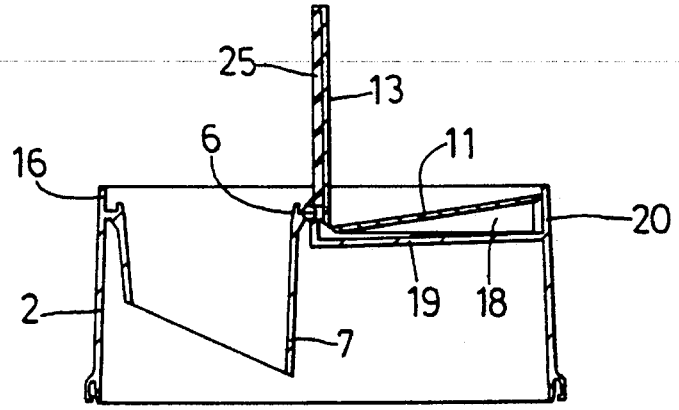
Figure 6:
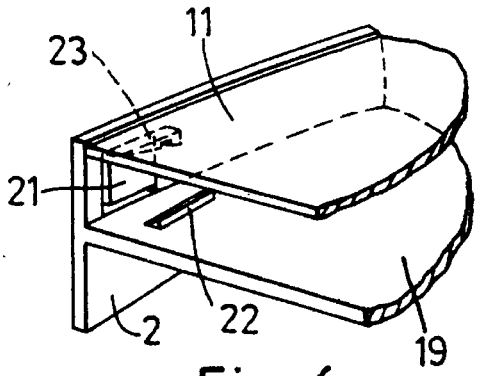
FIGS. 6 and 7 are cut-away portions of part of the lid and closure device as shown in FIG. 6 to indicate certain locking features.
Figure 7:
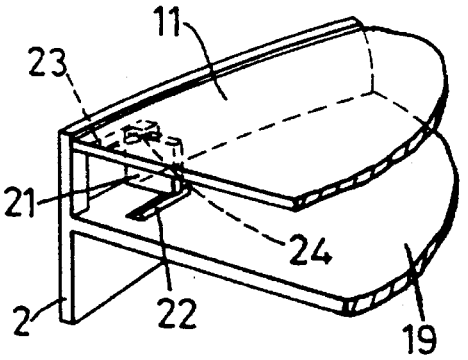

The closure device is provided by a flap 10 formed from a first portion 11 which is flexibly connected to the lid 2 by an integral strip 12 of the plastics moulding from which the lid is formed. A second portion 13 of the flap 10 is connected to the first portion 11 by an integral flexible hinge strip 14. As can be seen particularly from FIGS. 2 to 5 the second portion 13 carries pivot pins 15 which locate into holes at either side of an upstanding rim 16 of the lid portion 2. These pivot pins are slightly offset vertically and horizontally from the flexible hinge 14 thus enabling the flap 10 to be toggled between two stable conditions. The first of these is illustrated in FIG. 4 where the hinge 14 is snapped to a position above the pivot pins 15 thus pressing the second flap portion 13 positively down into the opening 6. If pressure is applied to a region generally indicated at 17 in FIG. 4 the flexible hinge 14 will be forced down past and below the pivot pins 15 thus causing the second flap portion 13 to flip upwardly into the stable condition illustrated in FIG. 5.

Angled ribs 18 at the lower surface of the first flap portion 11 give added strength to that portion 11 and also act to limit the extent to which the flap portion 11 can be pressed down onto the base wall 19 of a recessed part 20 of the lid 2. The first flap portion 11 can be locked into the raised position of FIG. 4 by means of tabs 21 in the side walls of the lid 2. As each tab 21 is pushed inwardly it rides up over a wedge 22 on the wall 19 and also slides along a wedge 23 on the under face of the flap portion 11 until it locates into a notch 24 in the wedge 23. The tabs 21 then prevent the flap portion 11 from being pressed downwardly to open the other portion 13 of the flap 10 and the tabs 21 are locked in place and cannot readily be restored to their original condition. Thus the container can be sealed against further opening.

The closure device shown in the drawings has been developed essentially as a receptacle for sharps and medical waste products. The closure portion 13 of the flap 10 carries, on its lower face, a layer of a resilient sealing material 25 (such as rubber). This will be pressed firmly down onto the perimeter of the opening 6 to seal against loss of the contents, particularly liquids. The chute 7 also makes it difficult for the contents to reach the opening 6 even if the container is turned upside down. If the closure device is to be used for temporary closure of, for example, a container for washing powder where the objective is that the contents should be capable of being poured out, then the chute 7 would be omitted so that the contents have direct access to the opening 6 when the container is tipped. Also the rim 16, at least in the region where it surrounds the opening 6, should ideally be omitted so as not to provide an obstruction to pouring.

I claim:

1. A container closure device comprising a lid portion having first and second ends, an opening defined in said lid portion, a flap, a flexible connection of said flap to said first end of the lid portion, said flap having a first portion towards said first end of the container and a second portion towards said second end of the container, a snap action hinge which is located on the lid portion and which has two stable conditions, said snap action hinge comprising a pivot connection to the lid portion and a flexible hinge close to said pivot across said first flap portion in a plane above the axis of said pivot, the first flap portion nearest said flexible connection forming an actuating member for the snap action hinge, and the second flap portion furthest from said flexible connection being positioned to close off said opening when the snap action hinge is in one of said two stable conditions, and being positioned fully to reveal said opening when the snap action hinge is in the other of said two stable conditions.

2. A device according to claim 1, wherein a recessed part is defined in the lid portion and receives the first flap portion.

3. A device according to claim 2, wherein the underside of the first flap portion within said recessed part carries ribs which angle down from the flexible hinge into the recess towards said flexible connection.

4. A device according to claim 1, including a locking device operable to prevent operation of said snap action hinge.

5. A device according to claim 4, wherein the locking device comprises at least one tab which is adjustable from a non-interfering position to lie in a locking position below said first flap portion near to said flexible hinge.

6. A device according to claim 5, wherein the tab in its locking position engages a holding formation on adjacent structure for resisting return movement of the tab.

7. A device according to claim 1, wherein the flap and the lid portion are combined as an integral plastics moulding and the flexible connection and the flexible hinge are integrally moulded as thinner portions of said plastics moulding.

8. A device according to claim 1, wherein the underside of said second flap portion carries a resilient sealing pad for sealing engagement over the opening in the lid portion.

9. A device according to claim 1, wherein the lid portion has an upstanding rim which will sit around the whole of the flap when the flap closes the opening.

10. A device according to claim 1, wherein a chute leads down into the container clear of the container walls, and a mouth is defined to said chute at the position of said opening.

* * * * *